US011078910B2

(12) United States Patent
D'Harboulle

(10) Patent No.: US 11,078,910 B2
(45) Date of Patent: Aug. 3, 2021

(54) PUMPING UNIT AND USE

(71) Applicant: PFEIFFER VACUUM, Annecy (FR)

(72) Inventor: Philippe D'Harboulle, Aix les Bains (FR)

(73) Assignee: PFEIFFER VACUUM, Annecy (FR)

( * ) Notice: Subject to any disclaimer, the term of this patent is extended or adjusted under 35 U.S.C. 154(b) by 164 days.

(21) Appl. No.: 16/500,847

(22) PCT Filed: Mar. 21, 2018

(86) PCT No.: PCT/EP2018/057211
§ 371 (c)(1),
(2) Date: Oct. 4, 2019

(87) PCT Pub. No.: WO2018/184853
PCT Pub. Date: Oct. 11, 2018

(65) Prior Publication Data

US 2020/0191147 A1 Jun. 18, 2020

(30) Foreign Application Priority Data

Apr. 7, 2017 (FR) ..... 17 53029

(51) Int. Cl.
*F04C 23/00* (2006.01)
*F04C 18/12* (2006.01)
*F04C 25/02* (2006.01)

(52) U.S. Cl.
CPC ..... *F04C 23/001* (2013.01); *F04C 18/126* (2013.01); *F04C 25/02* (2013.01);
(Continued)

(58) Field of Classification Search
CPC ..... F04C 18/126; F04C 23/001; F04C 25/02; F04C 28/02; F04C 2220/10;
(Continued)

(56) References Cited

U.S. PATENT DOCUMENTS 5,667,370 A * 9/1997 Im ..... F04C 18/084 418/150
7,140,846 B2 * 11/2006 Yamamoto ..... F04C 23/001 417/245
(Continued)

FOREIGN PATENT DOCUMENTS

EP 1 710 440 A2 10/2006
EP 2 518 323 A1 10/2012
(Continued)

OTHER PUBLICATIONS

International Search Report dated May 15, 2018 in PCT/EP2018/057211 filed on Mar. 21, 2018.

*Primary Examiner* — Mary Davis
*Assistant Examiner* — Dapinder Singh
(74) *Attorney, Agent, or Firm* — Oblon, McClelland, Maier & Neustadt, L.L.P.

(57) ABSTRACT

A pumping unit is provided, including a primary vacuum pump of a multistage dry type, including at least four pumping stages fitted in series; and a two-stage Roots vacuum pump, including a first pumping stage and a second pumping stage fitted in series, the second pumping stage being fitted in series with and upstream of a first pumping stage of the primary vacuum pump in a direction of flow of gases to be pumped, in which a ratio of a volume displacement of the first pumping stage of the two-stage Roots vacuum pump to a volume displacement of the second pumping stage of the two-stage Roots vacuum pump is less than six, and in which a ratio of a volume displacement of the second pumping stage of the two-stage Roots vacuum pump to a volume displacement of the first pumping stage of the primary vacuum pump is less than six.

14 Claims, 2 Drawing Sheets

Figure 4:
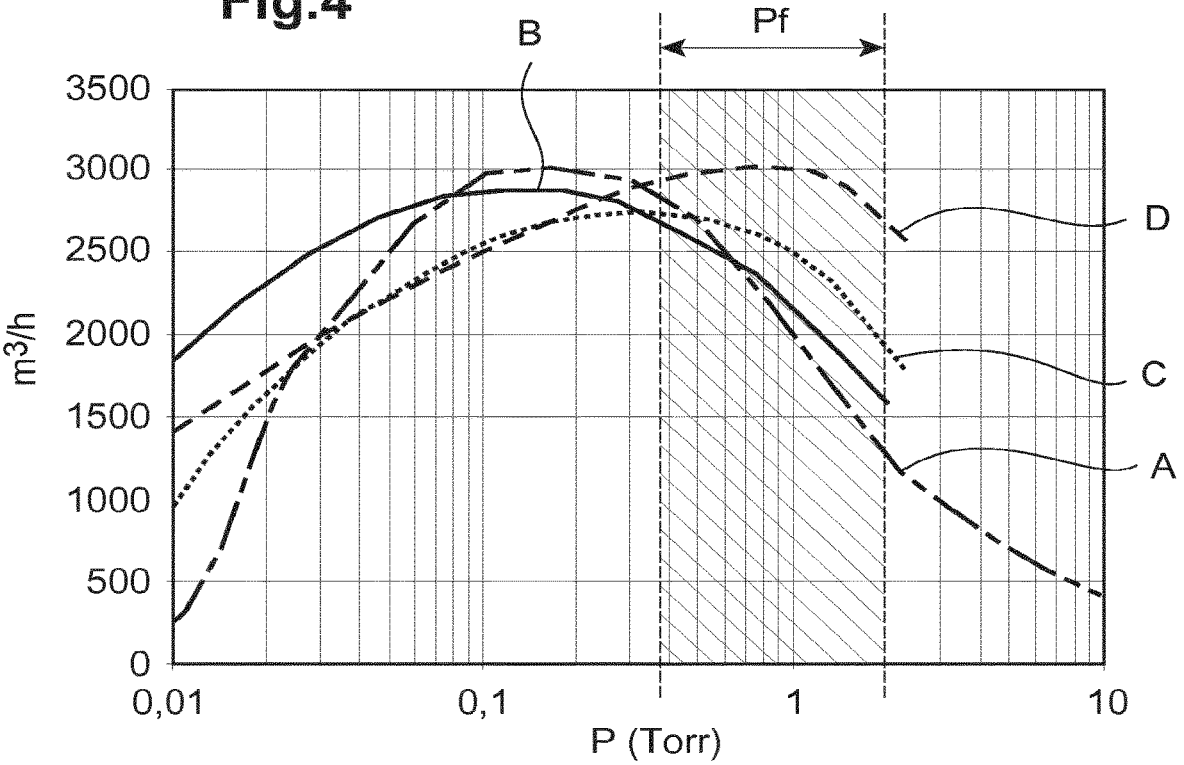

(52) U.S. Cl.
CPC ..... *F04C 2220/10* (2013.01); *F04C 2220/12* (2013.01); *F04C 2220/30* (2013.01); *F04C 2270/185* (2013.01)

(58) Field of Classification Search
CPC ..... F04C 2220/12; F04C 2220/30; F04C 2240/70; F04C 2270/21
See application file for complete search history.

(56) References Cited

U.S. PATENT DOCUMENTS

| | | | | |
|---|---|---|---|---|
| 7,214,036 | B2 * | 5/2007 | Yoshimura | F04C 18/084 417/252 |
| 8,328,542 | B2 * | 12/2012 | Murrow | F01C 1/20 418/9 |
| 10,190,585 | B2 * | 1/2019 | Denny | F04C 18/48 |
| 2004/0247465 | A1 | 12/2004 | Yoshimura | |
| 2006/0222506 | A1 | 10/2006 | Rival | |
| 2012/0251368 | A1 * | 10/2012 | Stephens | F04C 29/0092 418/1 |
| 2012/0257961 | A1 | 10/2012 | Tanigawa | |
| 2013/0164147 | A1 | 6/2013 | Graham | |
| 2015/0037187 | A1 * | 2/2015 | Turner | F01C 21/10 418/9 |

FOREIGN PATENT DOCUMENTS

| | | | |
|---|---|---|---|
| WO | WO 2007/063341 | A1 | 6/2007 |
| WO | WO 2017/031807 | A1 | 3/2017 |

* cited by examiner

Fig.1
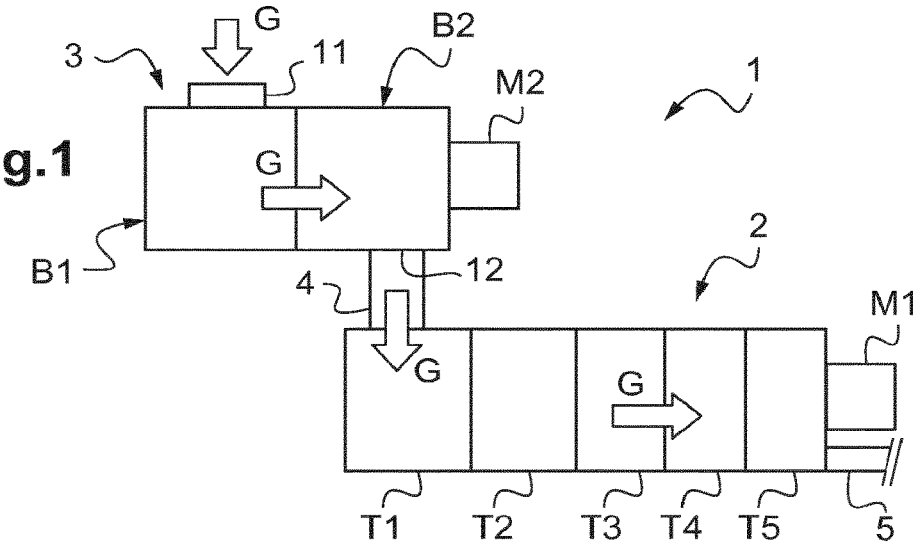
Fig.2
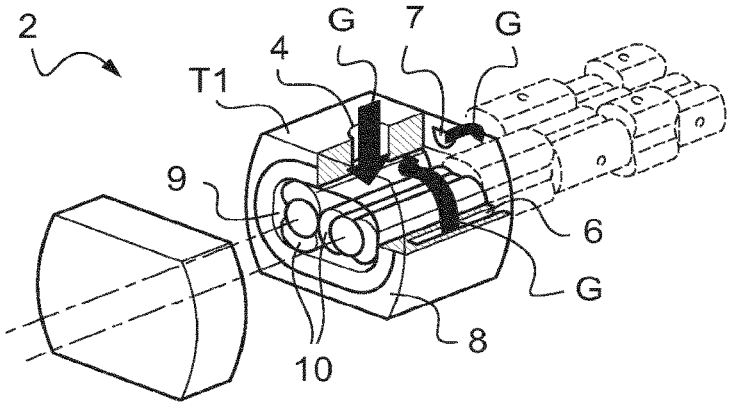
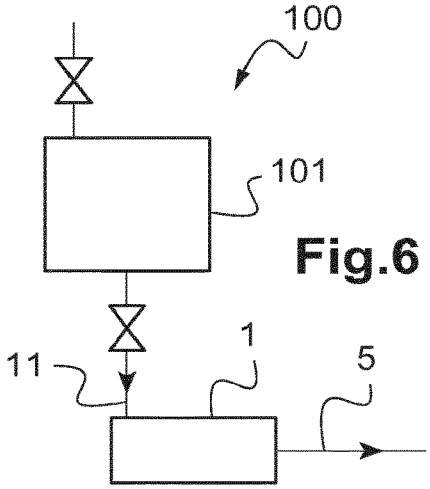
Fig.6
Fig.3
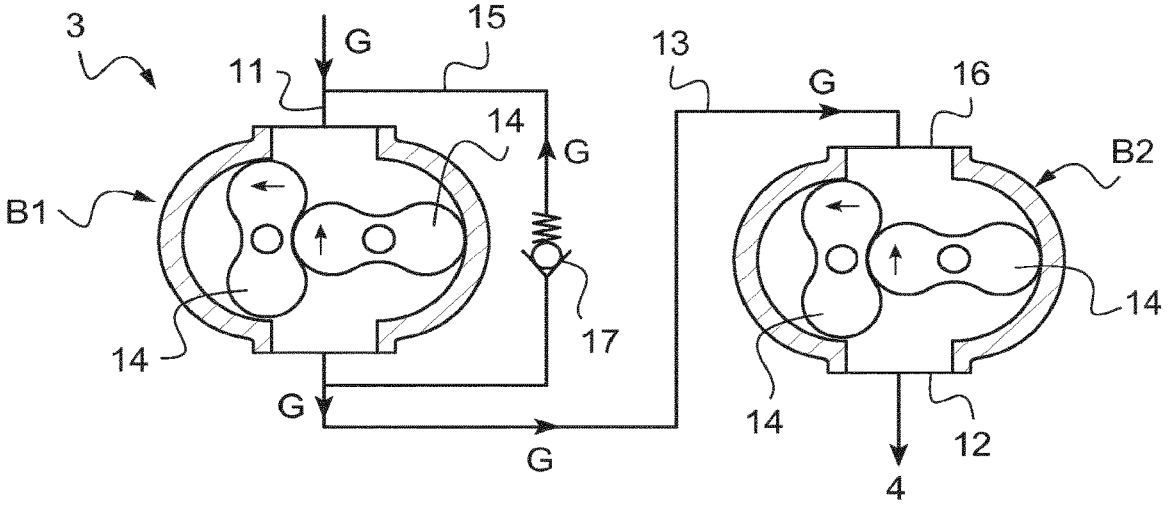

PUMPING UNIT AND USE

The present invention relates to a pumping unit comprising a primary vacuum pump of the multistage dry type and a vacuum pump of the two-stage Roots type, fitted in series with and upstream of the primary vacuum pump. The present invention also relates to a use of said pumping unit.

Primary vacuum pumps comprise a number of pumping stages in series, in which a gas to be pumped flows between an intake and a delivery end. Distinctive types of known primary vacuum pumps include those with rotary lobes, also known as Roots pumps, with two or three lobes, and those with double claws, also known as claw pumps.

Primary vacuum pumps comprise two rotors with identical profiles, rotating inside a stator in opposite directions. During the rotation, the gas to be pumped is trapped in the volume swept by the rotors and the stator, and is propelled by the rotors towards the next stage, and then progressively to the delivery end of the vacuum pump. Operation takes place without any mechanical contact between the rotors and the stator, so that there is no oil in the pumping stages. In this way, what is known as dry pumping can be provided.

To improve the pumping performance, particularly the flow rate, a Roots vacuum pump (known as a "Roots blower") is used, and is fitted in series with, and upstream of, the primary vacuum pump. The volume displacement of the Roots vacuum pump may be about twenty times the volume displacement of the primary vacuum pump.

Some applications, such as applications for thin film production in the semiconductor manufacturing industry, or CVD (for "Chemical Vapour Deposition") applications, require high pumping performance, notably for operating pressure ranges of between 53 Pa and 266 Pa, for continuously pumped flows of between 50 $Pa \cdot m^3 \cdot s^{-1}$ and 170 $Pa \cdot m^3 \cdot s^{-1}$. Notably, the aim is to obtain maximum pumping flow rates, of about 3000 $m^3/h$, in this operating range.

One solution for attempting to achieve these pumping capacities is that of using a Roots vacuum pump having the desired volume displacement to achieve 3000 $m^3/h$, fitted in series with a primary multistage vacuum pump with a volume displacement of about 300 $m^3/h$. The volume displacement of the Roots vacuum pump may thus be about ten times the volume displacement of the primary multistage vacuum pump. However, a significant loss of pumping performance has been observed in this device for pressures within the operating range of CVD applications, as well as at ultimate pressure. Moreover, this pumping device is highly energy-intensive, whereas it is equally desirable to limit power consumption.

Using two Roots vacuum pumps in series with and upstream of a primary multistage vacuum pump still fails to provide a satisfactory solution. This is because such an arrangement would be costly and bulky, and the use of two motors would result in mechanical losses and would have consequences in terms of power consumption.

One of the objects of the present invention is therefore to propose a pumping unit having better pumping performance in the operating range of CVD applications, as well as at ultimate pressure, while having a minimal power consumption.

For this purpose, the invention proposes a pumping unit comprising:

- a primary vacuum pump of the multistage dry type, comprising at least four pumping stages fitted in series, characterized in that the pumping unit comprises:

- a two-stage Roots vacuum pump, comprising a first and a second pumping stage fitted in series, the second pumping stage of the two-stage Roots vacuum pump being fitted in series with and upstream of the first pumping stage of the primary vacuum pump in the direction of flow of the gases to be pumped,
- the ratio of the volume displacement of the first pumping stage of the two-stage Roots vacuum pump to the volume displacement of the second pumping stage of the two-stage Roots vacuum pump being less than six, and
- the ratio of the volume displacement of the second pumping stage of the two-stage Roots vacuum pump to the volume displacement of the first pumping stage of the multistage dry primary vacuum pump being less than six.

With this architecture and these dimensions of the pumping unit, maximum pumping performance is obtained in the desired operating range, for pressures of between 53 Pa and 266 Pa, with flows that can be continuously pumped up to 170 $Pa \cdot m^3 \cdot s^{-1}$.

The pumping performance at ultimate vacuum is also satisfactory, at less than 0.1 Pa.

Additionally, the power consumption is minimal, whether at ultimate vacuum or in the desired operating range of CVD applications.

According to one or more characteristics of the pumping unit, considered individually or in combination:

- the volume displacement of the first pumping stage of the two-stage Roots vacuum pump is greater than or equal to 3000 $m^3/h$, being between 3500 $m^3/h$ and 5000 $m^3/h$ for example,
- the volume displacement of the second pumping stage of the two-stage Roots vacuum pump is greater than or equal to 500 $m^3/h$, being between 500 $m^3/h$ and 1000 $m^3/h$ for example,
- the ratio of the volume displacement of the first pumping stage of the two-stage Roots vacuum pump to the volume displacement of the second pumping stage of the two-stage Roots vacuum pump is less than 5.5, being between 4.5 and 5.5 for example,
- the ratio of the volume displacement of the second pumping stage of the two-stage Roots vacuum pump to the volume displacement of the first pumping stage of the multistage dry primary vacuum pump is less than or equal to five,
- the volume displacement of the first pumping stage of the primary vacuum pump is greater than or equal to 100 $m^3/h$, being between 100 $m^3/h$ and 400 $m^3/h$ for example,
- the ratio of the volume displacement of the first pumping stage of said primary vacuum pump to the volume displacement of the second pumping stage of said primary vacuum pump is less than or equal to three,
- the ratio of the volume displacement of the first pumping stage of the Roots vacuum pump to the volume displacement of the third pumping stage of the primary vacuum pump is less than or equal to one hundred and twenty,
- the ratio of the volume displacement of the final pumping stage of the primary vacuum pump to the volume displacement of the penultimate pumping stage of the primary vacuum pump is less than or equal to two,
- the primary vacuum pump comprises at least five pumping stages fitted in series,
- the pumping unit further comprises a passage connecting the intake of the two-stage Roots vacuum pump to the inlet of the second pumping stage of the two-stage Roots vacuum pump, the passage comprising a relief module (also called a "by-pass") configured to open as soon as the pressure difference between the intake and the delivery end of the first pumping stage exceeds a predefined value.

The invention also proposes a use of the pumping unit as described above for pumping out an enclosure of a semiconductor manufacturing installation, in which the pumping unit is used to control the pressure inside the enclosure at levels of between 53 Pa and 266 Pa, for pumped gas flows in the enclosure of between 50 $Pa \cdot m^3 \cdot s^{-1}$ and 170 $Pa \cdot m^3 \cdot s^{-1}$.

Figure 5:
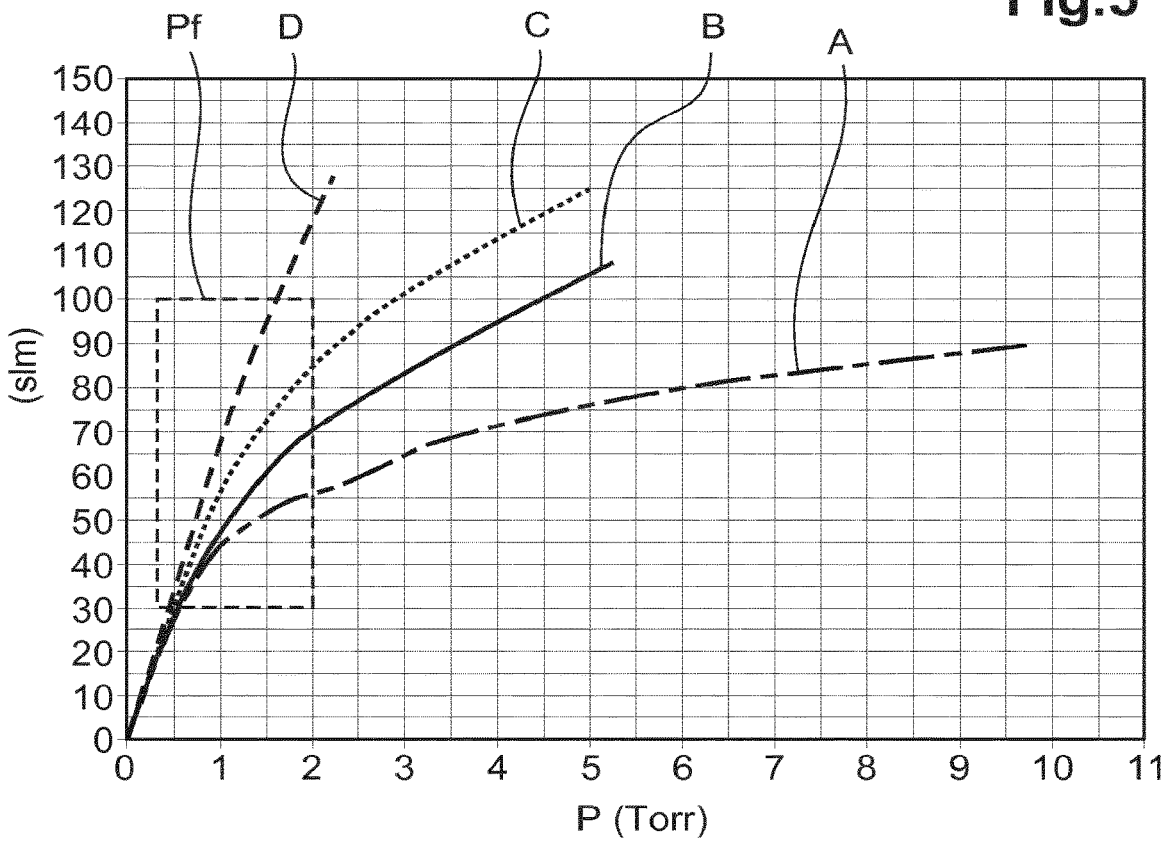

Other characteristics and advantages of the invention will be apparent from the following description, provided by way of non-limiting example, with reference to the attached drawings, in which:

FIG. 1 shows a schematic view of a pumping unit,

FIG. 2 shows example of embodiment of a primary vacuum pump, in which only the elements necessary for operation are depicted, FIG. 3 shows a schematic view of a two-stage Roots vacuum pump; this figure shows cross sections of pumping stages adjacent to one another for ease of understanding, FIG. 4 is a graph showing curves of pumping speed (in $m^3/h$) for a pumping unit according to the invention and for prior art pumping devices as a function of pressure (in Torr), FIG. 5 is a graph showing curves of pumped gas flow (in "slm", for "standard litres per minute") (1 slm=1.68875 $Pa \cdot m^3 \cdot s^{-1}$), as a function of pressure (in Torr) for the pumping unit and the pumping devices of FIG. 4, and FIG. 6 shows an example of the use of the pumping unit.

In these figures, identical elements bear the same reference numerals. The following embodiments are examples. Although the description refers to one or more embodiments, this does not necessarily mean that each reference relates to the same embodiment, or that the characteristics are applicable to a single embodiment only. Simple characteristics of different embodiments may also be combined or interchanged to provide other embodiments.

The expression "volume displacement" is taken to mean the capacity corresponding to the swept volume between the rotors and the stator of the vacuum pump, multiplied by the number of revolutions per second.

The expression "ultimate pressure" is taken to mean the minimum pressure obtained for a pumping device in the absence of a pumped gas flow.

The expression "dry primary vacuum pump" is taken to mean a positive displacement vacuum pump which uses two rotors to draw in, transfer and then deliver the gas to be pumped at atmospheric pressure. The rotor are driven in rotation by a motor of the primary vacuum pump.

The expression "Roots vacuum pump" (also called a "Roots blower") is taken to mean a positive displacement vacuum pump which uses rotors of the Roots type to draw in, transfer and then deliver the gas to be pumped. The Roots vacuum pump is fitted in series with, and upstream of, the primary vacuum pump. The Roots rotors are driven in rotation by a motor of the Roots vacuum pump.

The expression "upstream" is taken to refer to an element placed before another with respect to the direction of flow of the gas. Conversely, the expression "downstream" is taken to refer to an element placed after another with respect to the direction of flow of the gas to be pumped, the element located upstream being at a lower pressure than the element located downstream, which is at a higher pressure.

FIG. 1 shows a schematic view of a pumping unit 1.

The pumping unit 1 is, for example, used in an installation 100 in the semiconductor manufacturing industry (FIG. 6). The pumping unit 1 is, for example, connected to an enclosure 101 to be used for thin film production or for CVD ("chemical vapour deposition") applications, for which the operating range comprises pressures of between 53 Pa and 266 Pa and flows of gas pumped in the enclosure 101 which are usually between 50 $Pa \cdot m^3 \cdot s^{-1}$ and 170 $Pa \cdot m^3 \cdot s^{-1}$.

The pumping unit 1 comprises a primary vacuum pump 2 of the multistage dry type and a vacuum pump of the two-stage Roots type 3 (or "double stage blower"), fitted in series with, and upstream of, the primary vacuum pump 2.

The primary vacuum pump 2 shown here comprises five pumping stages T1, T2, T3, T4, T5 fitted in series between an intake 4 and a delivery end 5 of the primary vacuum pump 2, in which stages a gas to be pumped can flow.

Each pumping stage T1-T5 comprises a respective inlet and outlet. The successive pumping stages T1-T5 are connected in series with one another by respective inter-stage channels 6 connecting the outlet (or delivery end) of the preceding pumping stage to the inlet (or intake) of the following stage (see FIG. 2). The inter-stage channels 6 are, for example, arranged laterally in the body 8 of the vacuum pump 2, on either side of a central housing 9 accommodating the rotors 10. The inlet of the first pumping stage T1 communicates with the intake 4 of the vacuum pump 2 and the outlet of the last pumping stage T5 communicates with the delivery end 5 of the vacuum pump 2. The stators of the pumping stages T1-T5 form a body 8 of the vacuum pump 2.

The primary vacuum pump 2 comprises two rotary lobe rotors 10 extending into the pumping stages T1-T5. The shafts of the rotors 10 are driven from the side of the delivery stage T5 by a motor M1 of the primary vacuum pump 2 (FIG. 1).

The rotors 10 have lobes with identical profiles. The rotors depicted are of the Roots type (with a cross section in the form of a "number eight" or a "kidney bean"). Evidently, the invention is equally applicable to other types of dry multistage primary vacuum pumps, such as those of the claw, spiral or screw type, or those operating on another similar positive displacement vacuum pump principle.

The rotors 10 are angularly offset and driven so as to revolve in a synchronized manner in opposite directions in the central housing 9 of each stage T1-T5. During the rotation, the gas drawn in from the inlet is trapped in the volume swept by the rotors 10 and the stator, and is then driven by the rotors towards the next stage (the direction of flow of the gases is illustrated by the arrows G in FIGS. 1 and 2).

The primary vacuum pump 2 is called "dry" because, in operation, the rotors 10 revolve inside the stator without any mechanical contact with the stator, so that there is no oil in the pumping stages T1-T5.

The pumping stages T1-T5 have a swept volume, that is to say a volume of gas pumped, that decreases (or is equal) with the pumping stages, the first pumping stage T1 having the highest volume displacement and the final pumping stage T5 having the lowest volume displacement.

The delivery pressure of the primary vacuum pump 2 is equal to atmospheric pressure. The primary vacuum pump 2 further comprises a check valve at the outlet of the final pumping stage T5, at the delivery end 5, to prevent the return of pumped gases into the vacuum pump 2.

A two-stage Roots vacuum pump 3 is shown schematically in FIG. 3.

Like the primary vacuum pump 2, the Roots vacuum pump 3 is a positive displacement vacuum pump which uses two rotors to draw in, transfer and then deliver the gas to be pumped.

The two-stage Roots vacuum pump 3 comprises a first and a second pumping stage B1, B2, fitted in series between an intake 11 and a delivery end 12, in which stages a gas to be pumped can flow.

Each pumping stage B1-B2 comprises a respective inlet and outlet, the inlet 16 (or intake) of the second pumping stage B2 being connected to the outlet (or delivery end) of the first pumping stage B1 by an inter-stage channel 13. The inlet of the first pumping stage B1 communicates with the intake 11 of the pumping unit 1, and the outlet of the second pumping stage B2 (the delivery end 12) is connected to the intake 4 of the primary vacuum pump 2.

The Roots vacuum pump 3 comprises two rotary lobe rotors 14 extending in the pumping stages B1-B2. The shafts of the rotors 14 are driven by a motor M2 of the Roots vacuum pump 3 (FIG. 1).

The rotors 14 have lobes with identical profiles of the Roots type.

The rotors 14 are angularly offset and driven so as to revolve in a synchronized manner in opposite directions in the central housing forming the chambers of each stage B1-B2. During the rotation, the gas drawn in from the inlet is trapped in the volume swept by the rotors and the stator, and is then driven by the rotors towards the next stage (the direction of flow of the gases is illustrated by the arrows G in FIGS. 1 and 3).

The Roots vacuum pump 3 is called "dry" because, in operation, the rotors revolve inside the stator without any mechanical contact with the stator, so that there is no oil in the pumping stages B1-B2.

The Roots vacuum pump 3 mainly differs from the primary vacuum pump 2 in the larger dimensions of the pumping stages B1-B2, due to the greater pumping capacities, in the tolerances, in the greater degree of play, and in that the Roots vacuum pump 3 does not deliver at atmospheric pressure but must be used in a serial arrangement, upstream of a primary vacuum pump.

The pumping unit 1 further comprises a passage 15 connecting the intake 11 of the Roots vacuum pump 3 to the inlet 16 of the second pumping stage B2 of the Roots vacuum pump 3.

The passage 15 comprises a relief module 17, such as a check valve or a controlled valve, configured to open as soon as the pressure difference between the intake 11 and the delivery end of the first pumping stage B1 exceeds a predefined level, for example between $5.10^3$ Pa and $3.10^4$ Pa.

The opening of the relief module 17 enables the excess gas flow from the delivery end of the first pumping stage B1 to be recycled towards the intake 11 of the Roots vacuum pump 3. This recycling takes place when the pressure of the enclosure 101 falls below atmospheric pressure, because of the high gas flow at the start of pumping. This avoids the generation of high pressure at the delivery end of the first pumping stage B1, which could result in very high power consumption, excessive heating, and a risk of malfunction.

The ratio of the volume displacement of the first pumping stage B1 of the Roots vacuum pump 3 to the volume displacement of the second pumping stage B2 of the Roots vacuum pump 3 is less than six, being less than 5.5 or between 4.5 and 5.5 for example.

The volume displacement of the first pumping stage B1 of the two-stage Roots vacuum pump 3 is, for example, greater than or equal to 3000 $m^3$/h, being between 3500 $m^3$/h and 5000 $m^3$/h for example.

The volume displacement of the second pumping stage B2 of the two-stage Roots vacuum pump 3 is, for example, greater than or equal to 500 $m^3$/h, being between 500 $m^3$/h and 1000 $m^3$/h for example.

The volume displacement of the first pumping stage B1 of the Roots vacuum pump 3 is, for example, about 4459 $m^3$/h.

The volume displacement of the second pumping stage B2 of the Roots vacuum pump 3 is, for example, about 876 $m^3$/h.

The ratio of the volume displacement of the first pumping stage B1 to the volume displacement of the second pumping stage B2 is thus about 5.1.

Additionally, the ratio of the volume displacement of the second pumping stage B2 of the Roots vacuum pump 3 to the volume displacement of the first pumping stage T1 of the primary vacuum pump 2 is less than six, being less than or equal to five for example.

The volume displacement of the first pumping stage T1 of the primary vacuum pump 2 is, for example, greater than or equal to 100 $m^3$/h, being between 100 $m^3$/h and 400 $m^3$/h for example.

The first pumping stage T1 of the primary vacuum pump 2 has, for example, a volume displacement of about 187 $m^3$/h.

The ratio of the volume displacement of the second pumping stage B2 to the volume displacement of the first pumping stage T1 is thus equal to about 4.7.

The ratio of the volume displacement of the first pumping stage T1 of the primary vacuum pump 2 to the volume displacement of the second pumping stage T2 of the primary vacuum pump 2 is, for example, less than or equal to three.

The second pumping stage T2 has, for example, a volume displacement of about 93 $m^3$/h. The ratio of the volume displacement of the first pumping stage T1 to the volume displacement of the second pumping stage T2 is thus substantially equal to two.

The ratio of the volume displacement of the first pumping stage B1 of the two-stage Roots vacuum pump 3 to the volume displacement of the third pumping stage T3 of the primary vacuum pump 2 is, for example, less than or equal to a hundred and twenty. The at least two final pumping stages T4, T5, T6 of the primary vacuum pump 2 may have the same volume displacements.

The ratio of the volume displacement of the final pumping stage T5 of the primary vacuum pump 2 to the volume displacement of the penultimate pumping stage T4 of the primary vacuum pump 2 is, for example, less than or equal to two.

The final three pumping stages T3, T4 and T5 have, for example, a volume displacement of about 44 $m^3$/h. The ratio of the volume displacement of the first pumping stage B1 of the secondary two-stage Roots vacuum pump 3 to the volume displacement of the third pumping stage T3 of the primary vacuum pump 2 is thus about 101.3. The ratio of the volume displacement of the final pumping stage T5 of the primary vacuum pump 2 to the volume displacement of the penultimate pumping stage T4 of the primary vacuum pump 2 is thus equal to one in this case.

The final pumping stages T4, T5, T6 of the primary vacuum pump 2, having the same volume displacements, make it possible to simplify manufacturing and reduce costs.

This design of the pumping unit 1 makes it possible to optimize the pumping performance, which is optimal in the operating range of CVD methods. The pumping performance at ultimate vacuum is also satisfactory. Additionally, the power consumption is minimal, whether at ultimate vacuum or at operating pressures.

This may be understood more readily by examining the graphs in FIGS. 4 and 5, which show the pumping performance found for a pumping unit 1 according to the invention and for prior art pumping devices.

Curve A is a curve of the pumping speed as a function of the pressure found for a prior art pumping device comprising a single-stage Roots vacuum pump with an estimated volume displacement of 4459 $m^3/h$, fitted in series with, and upstream of, a primary vacuum pump with an estimated volume displacement of 510 $m^3/h$.

This pumping device can reach a pumping speed of about 3000 $m^3/h$ for pressures of between 13 Pa and 26 Pa (or 0.1 Torr and 0.2 Torr). Above 53 Pa (or 0.4 Torr), however, the performance declines very abruptly, so that the performance of the pumping device is inadequate in the desired operating range (marked Pf on the graphs of FIGS. 4 and 5). The pumping speed for pressures below 13 Pa (or 0.1 Torr) (at ultimate vacuum) is also less satisfactory. Moreover, the power consumption at ultimate pressure is about 3.3 kW, which is high.

Curve B shows the pumping performance as a function of the pressure found for a prior art pumping device comprising a single-stage Roots vacuum pump with an estimated volume displacement of 4459 $m^3/h$, fitted in series with, and upstream of, a primary vacuum pump with an estimated volume displacement of 260 $m^3/h$.

It can be seen that the pumping performance at ultimate pressure is better than for the pumping device of curve A. However, the pumping speed does not reach the desired performance of 3000 $m^3/h$ in the operating range Pf.

Curve C shows the pumping performance as a function of pressure found for a prior art pumping device comprising a Roots vacuum pump with an estimated volume displacement of 4459 $m^3/h$, fitted in series with, and upstream of, a primary vacuum pump with an estimated volume displacement of 510 $m^3/h$. The design of the final pumping stage of the primary vacuum pump of the pumping device of curve C, with an estimated volume displacement of about 109 $m^3/h$, is much better (bigger or higher) than that of the pumping device of curve A, with an estimated volume displacement of about 58 $m^3/h$.

It is found that the pumping performance is substantially better than for the pumping device of curve B in the operating range Pf. However, the pumping speed does not reach 3000 $m^3/h$ and decreases in the operating range, and the power consumption at ultimate pressure is much too high (at about 5.7 kW) because of the overdesign of the final pumping stage of the primary vacuum pump. Moreover, the pumping performance is unsatisfactory at ultimate pressure.

Curve D shows the pumping performance as a function of the pressure found for a pumping unit 1 according to the invention in which the volume displacement of the first pumping stage B1 of the Roots vacuum pump 3 is about 4459 $m^3/h$, the volume displacement of the second pumping stage B2 of the Roots vacuum pump 3 is about 876 $m^3/h$, the first pumping stage T1 of the primary vacuum pump 2 has a volume displacement of about 187 $m^3/h$, the second pumping stage T2 of the primary vacuum pump 2 has a volume displacement of about 93 $m^3/h$, and the final three pumping stages T3, T4 and T5 of the primary vacuum pump 2 have a volume displacement of about 44 $m^3/h$.

It is found that the pumping performance is at a maximum of about 3000 $m^3/h$ in the desired operating range Pf.

The pumping performance at ultimate vacuum is also satisfactory.

Furthermore, the power consumption is satisfactory. It is less than 2.5 kW at ultimate pressure.

The invention claimed is:

1. A pumping unit, comprising:

a primary vacuum pump of a multistage dry type, comprising at least four pumping stages fitted in series; and a two-stage Roots vacuum pump, comprising a first pumping stage and a second pumping stage fitted in series, the second pumping stage being fitted in series with and upstream of a first pumping stage of the primary vacuum pump in a direction of flow of gases to be pumped, wherein a ratio of a volume displacement of the first pumping stage of the two-stage Roots vacuum pump to a volume displacement of the second pumping stage of the two-stage Roots vacuum pump being less than six, and wherein a ratio of a volume displacement of the second pumping stage of the two-stage Roots vacuum pump to a volume displacement of the first pumping stage of the primary vacuum pump being less than six.

2. The pumping unit according to claim 1, wherein the volume displacement of the first pumping stage of the two-stage Roots vacuum pump is greater than or equal to 3000 $m^3/h$.

3. The pumping unit according to claim 1, wherein the volume displacement of the first pumping stage of the two-stage Roots vacuum pump is between 3500 $m^3/h$ and 5000 $m^3/h$.

4. The pumping unit according to claim 1, wherein the volume displacement of the second pumping stage of the two-stage Roots vacuum pump is greater than or equal to 500 $m^3/h$.

5. The pumping unit according to claim 1, wherein the volume displacement of the second pumping stage of the two-stage Roots vacuum pump is between 500 $m^3/h$ and 1000 $m^3/h$.

6. The pumping unit according to claim 1, wherein the ratio of the volume displacement of the first pumping stage of the two-stage Roots vacuum pump to the volume displacement of the second pumping stage of the two-stage Roots vacuum pump is less than 5.5.

7. The pumping unit according to claim 1, wherein the ratio of the volume displacement of the second pumping stage of the two-stage Roots vacuum pump to the volume displacement of the first pumping stage of the primary vacuum pump is less than or equal to five.

8. The pumping unit according to claim 1, wherein the volume displacement of the first pumping stage of the primary vacuum pump is greater than or equal to 100 $m^3/h$.

9. The pumping unit according to claim 1, wherein the volume displacement of the first pumping stage of the primary vacuum pump is between 100 $m^3/h$ and 400 $m^3/h$.

10. The pumping unit according to claim 1, wherein the ratio of the volume displacement of the first pumping stage of the primary vacuum pump to the volume displacement of the second pumping stage of the primary vacuum pump is less than or equal to three.

11. The pumping unit according to claim 1, wherein the ratio of the volume displacement of the first pumping stage of the two-stage Roots vacuum pump to the volume displacement of the third pumping stage of the primary vacuum pump is less than or equal to 120.

12. The pumping unit according to claim 1, wherein the primary vacuum pump comprises at least five pumping stages fitted in series.

13. The pumping unit according to claim 1, further comprising a passage connecting an intake of the two-stage Roots vacuum pump to an inlet of the second pumping stage of the two-stage Roots vacuum pump, the passage comprising a relief module configured to open as soon as a pressure difference between the intake and a delivery end of the first pumping stage exceeds a predefined value.

14. The pumping unit according to claim 1, wherein the pumping unit is configured to:

pump out an enclosure of a semiconductor manufacturing installation, and control a pressure inside the enclosure at levels of between 53 Pa and 266 Pa, for pumped gas flows in the enclosure of between 50 $Pa \cdot m^3 \cdot s^{-1}$ and 170 $Pa \cdot m^3 \cdot s^{-1}$.

* * * * *